US007089613B2

(12) United States Patent
Cohen

(10) Patent No.: US 7,089,613 B2
(45) Date of Patent: Aug. 15, 2006

(54) FLEXING HEAD SUPPORT SUSPENSION SYSTEM

(76) Inventor: Jeffrey R Cohen, 170 Solano St., San Rafael, CA (US) 94901

( * ) Notice: Subject to any disclaimer, the term of this patent is extended or adjusted under 35 U.S.C. 154(b) by 44 days.

(21) Appl. No.: 10/960,368

(22) Filed: Oct. 6, 2004

(65) Prior Publication Data

US 2005/0109346 A1 May 26, 2005

Related U.S. Application Data

(60) Provisional application No. 60/550,906, filed on Mar. 8, 2004, provisional application No. 60/524,631, filed on Nov. 25, 2003.

(51) Int. Cl.
*A47B 7/00* (2006.01)

(52) U.S. Cl. ..... 5/622; 637/640; 637/642

(58) Field of Classification Search ..... 5/622, 5/637, 638, 640, 643, 642, 636; 601/24, 601/25, 26, 23, 86, 90, 98; 606/240, 241, 606/243

See application file for complete search history.

(56) References Cited

U.S. PATENT DOCUMENTS

| | | | | |
|---|---|---|---|---|
| 2,872,259 | A * | 2/1959 | Thorpe | 5/613 |
| 4,649,905 | A | 3/1987 | Barnes | |
| 4,660,549 | A | 4/1987 | Kowalski et al. | |
| 4,711,230 | A | 12/1987 | Berke et al. | |
| 4,724,828 | A | 2/1988 | Barnes et al. | |
| 4,943,041 | A | 7/1990 | Romein | |
| 5,177,823 | A * | 1/1993 | Riach | 5/636 |
| 5,192,306 | A | 3/1993 | Scott et al. | |
| 5,233,713 | A * | 8/1993 | Murphy et al. | 5/636 |
| 5,317,771 | A * | 6/1994 | Cook | 5/637 |
| 5,408,713 | A * | 4/1995 | Stratton et al. | 5/632 |
| 5,427,436 | A * | 6/1995 | Lloyd | 297/408 |
| 5,970,546 | A * | 10/1999 | Danis | 5/636 |
| 6,148,460 | A * | 11/2000 | Fried et al. | 5/661 |
| 6,151,734 | A | 11/2000 | Lawrie | |
| 6,397,414 | B1 | 6/2002 | Lloyd | |
| 6,436,126 | B1 | 8/2002 | McAfee | |
| 6,568,006 | B1 * | 5/2003 | Hyland | 5/421 |
| 6,594,839 | B1 | 7/2003 | Papay | |
| 6,718,581 | B1 * | 4/2004 | Riach | 5/632 |
| 6,718,582 | B1 * | 4/2004 | Tinsley | 5/640 |
| 6,928,679 | B1 * | 8/2005 | Gross | 5/638 |
| 2002/0095182 | A1 | 7/2002 | Taylor et al. | |

* cited by examiner

*Primary Examiner*—Henry Bennett
*Assistant Examiner*—Camtu Nguyen
(74) *Attorney, Agent, or Firm*—Intellectual Property Law Group LLP; Otto O. Lee; Marie Grace Capuyan

(57) ABSTRACT

A flexing head support suspension system for supporting the head, neck, and, face of a subject while the subject receives a treatment. The suspension system comprises a pressure sensitive apparatus for supporting the head, neck, and face. The apparatus includes a face plate and a suspension support unit. The suspension mechanism in the support unit maintains a neutral placement of the head in relation to the body while the subject is undergoing treatment. The apparatus alleviates discomfort and pain that often comes as a result of the pressure on the body during treatment of various somatic modalities. The apparatus may be a stand alone unit or attachable to both standard and non-standard massage tables.

3 Claims, 5 Drawing Sheets

FLEXING HEAD SUPPORT SUSPENSION SYSTEM

CROSS REFERENCE

This application claims priority of U.S. Provisional Applications Nos. 60/524,631 filed Nov. 25, 2003, and 60/550,906 filed Mar. 8, 2004, which are incorporated herein by reference.

BACKGROUND OF THE INVENTION

1. Field of Invention

The present invention generally relates to head rests and head support devices for use during therapeutic massage, chiropractic, cosmetic or any other physical therapeutic treatment.

2. Background of the Invention

Chiropractors and other health practitioners utilize numerous types of tables for use during examinations, adjustments and treatments of patients. When such tables are used, the tables are commonly designed so that the patient's head is supported during treatment, particularly when the patient is lying face down. The placing of a patient's spine and neck joints in a neutral position during treatment is desirable. When a bench or treatment table includes a separate headrest, the headrest must be properly adjusted to avoid compression of the patient's neck.

Several attempts have been made to devise head support devices that are attachable to a massage or examination table. One reference describes a head rest detachably affixed to a light-weight folding massage table. The head rest has a pair of support tubes inserted into the end of a table section, and held in place by a spring and tab permitting the headrest to be optionally raised or lowered; and an outwardly facing U-shaped tube, covered widthwise with a soft fabric material to provide a supporting surface for a patient's face. The problem is that once the head rest is manually adjusted the position is fixed and static while the patient receives treatment. The face support rest does not move during a treatment and can therefore cause an increase of pressure on the patient's face, sinuses and cervical spine.

Others describe a portable and adjustable head rest or support apparatus that may be used in conjunction with conventional bedding mattresses to eliminate the need for a special massage table or chair. The apparatus is particularly designed for home use and provides an alternative to specially designed massage tables by converting a conventional bedding mattress into a massage table. The head support apparatus comprises a base, a face plate, a cushion and an adjuster for enabling vertical adjustment of the apparatus. The face plate further has a horseshoe-shaped plate supported by the legs. The cushion is detachably mounted to the face plate. The vertical adjustment of this apparatus is secured at user-selected positions. However, the same problem is encountered here as with previously mentioned prior art because the face plate once adjusted and secured does not move; thus uncomfortable pressure is exerted on the patient's face, sinuses and cervical spine during treatment.

Still others describe a chiropractic adjustment device for use in applying toggle recoil to a vertebrae comprising a headrest placed upon a set of compression springs mounted on top of a base. The base is of a U-shaped or channel configuration. The apparatus includes a pair of latches that have a catch formed with catch elements and a latch bar for catching and holding the headrest in various positions relative to the base. The device may be incorporated into a table if desired. The patient's head is positioned upon the headrest with either left or right cheek laying flat on the headrest. When manual force is applied abruptly and downwardly to the vertebrae to be treated, the pressure causes the patient's head and headrest to move abruptly downward. Thus, with such an adjustment device, the headrest is urged downwardly a distance in proportion to the clinical force applied and then permitted to move back upwardly a short distance to provide positive recoil. The drawback with this device is that the adjustment is not flexible once the latch is engaged. There is no continual suspension provided during a treatment. The latch may be released. However, once the latch catches and holds the headrest in the desired position and distance in proportion to the clinical force applied, the patient's head is in a fixed position causing an increase of pressure in the patient's face and cervical spine when subsequent pressure or force is applied to the patient without first manually releasing the catch.

While some of these described devices provide adjustable head support for a patient for use with treatment tables they do not provide suspension or compensation during a treatment. Many head and face support devices in the past have opted to employ securing or locking mechanisms to stabilize the head and neck in the desired positions.

There is a need in the art, therefore, for a head, neck and face support apparatus for maintaining proper placement of the cervical spine and to provide head and neck comfort in the face cradle apparatus of a treatment table during treatment. Other devices disclose support systems that are static. Where devices have been made to provide a head support apparatus useful for converting a conventional bedding mattress set into a massage table, the device does not flex or compensate for the remainder of the body's movement during a treatment; therefore causing an increase of pressure on the patient's face, sinuses and cervical spine. Most of the current devices are static and the support devices do not move once the subject's head is placed in the apparatus. The prior devices are primarily focused on supporting the head with the face forward and not turned to either side. This has been achieved in various ways as demonstrated by the products available.

Accordingly, it is a principal object of the invention to provide a suspension system for maintaining proper placement of the cervical spine which not only supports the head, neck and face but also adjusts for constant changes in pressure on the entire body during a treatment. As a result, it is an object of the invention to provide comfort and relief for the subject's face, head and neck as the body settles with the cervical spine into a neutral passive position. The subject does not leave the treatment table with lines on their face or stuffy sinuses from the pressure of the static resistance. Stress to the cervical spine is limited. Further, a subject wearing contact lenses is relieved of discomfort to the eyes from excessive pressure to the face.

It is a further object of the present invention to provide a head, neck, and face suspension system that can be incorporated into any standard or non-standard massage table.

It is a further object of the present invention to provide a head, neck, and face suspension system that can be incorporated into a torso platform, turning a flat surface into a massage table.

Further objects of the invention will become apparent from the following description.

SUMMARY OF THE INVENTION

The embodiments of the present invention solve the problems and address the drawbacks of the approaches in the above description. An embodiment of the present invention includes an apparatus for supporting the head, neck and face of a subject comprising a face plate and a suspension support unit. The face plate is supported by the suspension unit. The suspension unit includes a spring loaded component which provides the subject noticeable comfort and relief for the head, neck, and face. Upon commencement of treatment to the subject's cervical, thoracic and lumbar areas of the back, is a continued sense of comfort and relief to the head, face, sinuses, and neck as the pressure of the treatment is constantly adjusted by the suspension system. Spring loading the face plate provides suspension for the head, neck, and face when pressure is applied; thus leaving the cervical spine, head, neck, and face in a comfortable and neutral position without undue pressure to the sinuses and eyes. Further, due to the neutral and suspended nature, more access to treatment of the head and neck is available.

A preferred embodiment of the present invention includes a flexing head support suspension system having a universal track support bracket with adjustable connecting rods for attachment to both standard and non-standard massage tables.

Additional alternative embodiments of the present invention include a flexing head support suspension system that can be rigidly attached to a torso massage platform, turning a flat surface such as a bed or table into a massage table.

Further embodiments of the present invention include a flexing head support suspension system with standard support brackets for attachment to a torso massage platform.

Still another embodiment of the present invention is a head support suspension system with a leaf spring bracket, attached to a torso massage platform.

These and other embodiments of the present invention are further made apparent, in the remainder of the present document, to those of ordinary skill in the art.

DESCRIPTION OF THE DRAWINGS

In order to more fully describe embodiments of the present invention, reference is made to the accompanying drawings. These drawings are not to be considered limitations in the scope of the invention, but are merely illustrative.

DETAILED DESCRIPTION OF SPECIFIC EMBODIMENTS

The description above and below and the drawings of the present document focus on one or more preferred embodiments of the present invention and also describe some exemplary optional features and/or alternative embodiments. The description and drawings are for the purpose of illustration and not limitation. Those of ordinary skill in the art will recognize variations, modifications, and alternatives. Such variations, modifications, and alternatives are also within the scope of the present invention. Section titles are terse and are for convenience only.

Figure 1:
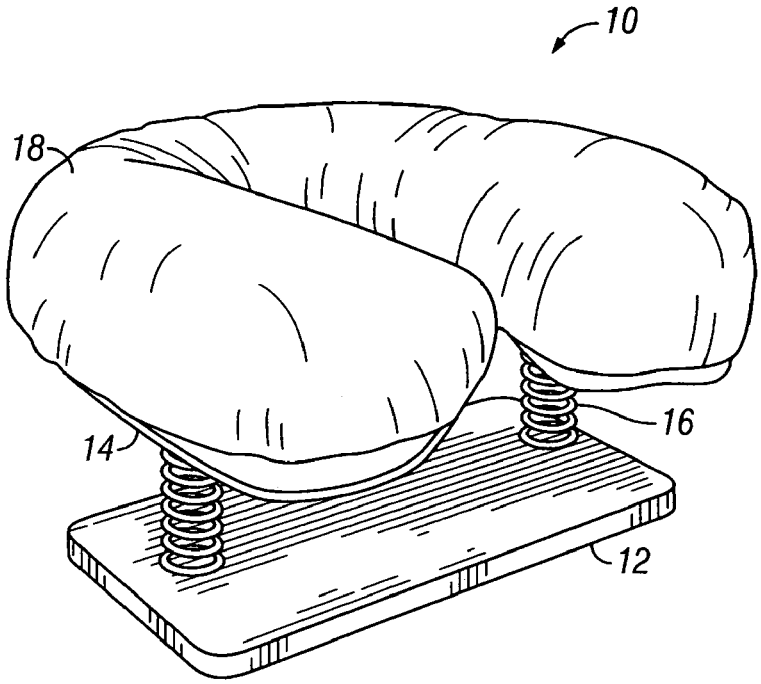
FIG. 1 shows a basic structure of a head support suspension apparatus with stand alone base according to an embodiment of the present invention.

An embodiment of the present invention includes a head support suspension apparatus 10 with stand alone base 12, as shown in FIG. 1. Suspension apparatus 10 comprises a face plate 14, a suspension support unit 16, and a stand alone base 12. Face plate 14 has a top side, an underside and may be U-shaped. An attachment bracket is fixed to the underside of face plate 14. Suspension support unit 16 may comprise of any suspension or compression means, such as but not limited to, spring coils 16 for adjusting the pressure to the head, neck, and face while the subject receives treatment on the cervical, thoracic, and lumbar areas of the back. The subject's cervical spine, head, neck, and face are left in a comfortable and neutral position without undue pressure to the sinuses and eyes. Base 12 is made up of any solid material sufficiently strong enough to mount suspension support unit 16 with face plate 14. A first end of spring coil 16 attaches to the attachment bracket on the underside of face plate 14. A second end of spring coil 16 attaches to base 12 by an attachment means, such as a screw attachment. A face cushion 18 may be added to top side of face plate 14 for added comfort to the subject's head and face.

Figure 2A:
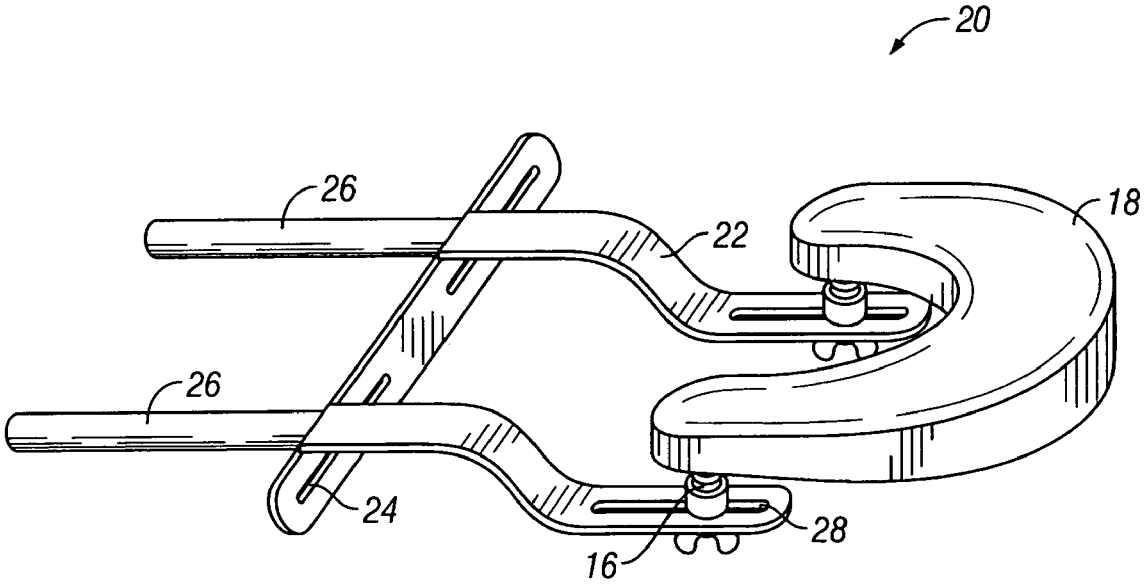
FIG. 2A shows a head support suspension system with a universal track support bracket and adjustable connecting rods according to an embodiment of the present invention.
Figure 2B:
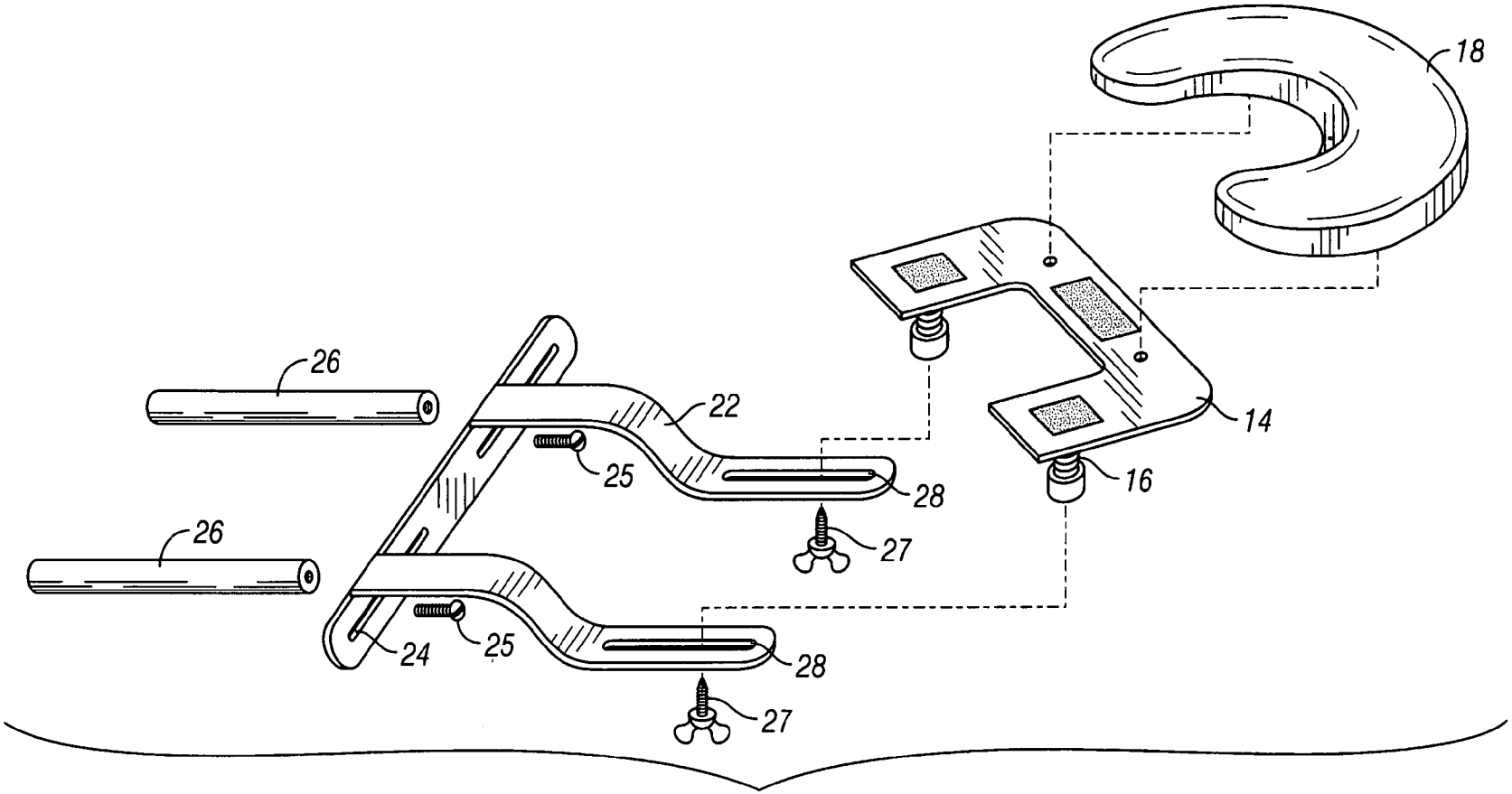
FIG. 2B shows an exploded view of a head support suspension system with a universal track support bracket and adjustable connecting rods according to an embodiment of the present invention.

Referring now to FIGS. 2A–2B is a preferred embodiment of the present invention which includes a head support suspension system 20 for attachment to standard and non-standard massage tables. Suspension system 20 comprises a face plate 14 (see FIG. 2B), a suspension support unit 16, and a universal track support bracket 22. Suspension support unit 16 connects face plate 14 to universal track support bracket 22. Universal track support bracket 22 has horizontal tracks 24 and vertical tracks 28. Suspension support unit 16 has an upper end and a lower end. The upper end of suspension support unit 16 attaches to the attachment bracket on the underside of face plate 14. The lower end of the suspension support unit 16 attaches to vertical track 28 via an adjustable fastening means, such as a screw fastener 27. The position of the suspension support unit 16 may be adjusted on vertical track 28 by sliding suspension support unit 16 to desired position along vertical track 28. A pair of connecting rods 26 each having a first end and a second end, is attached to universal track support bracket 22. The first end of each connecting rod 26 fits into horizontal track 24. The position of the first end of each connecting rod 26 may be adjusted on horizontal track 24 by sliding the first end of each connecting rod 26 into the desired position along horizontal track 24 and securing with an adjustable fastening means, such as a screw fastener 25. The second end of each connecting rod 26 inserts into any standard and non-standard massage table.

Figure 3A:
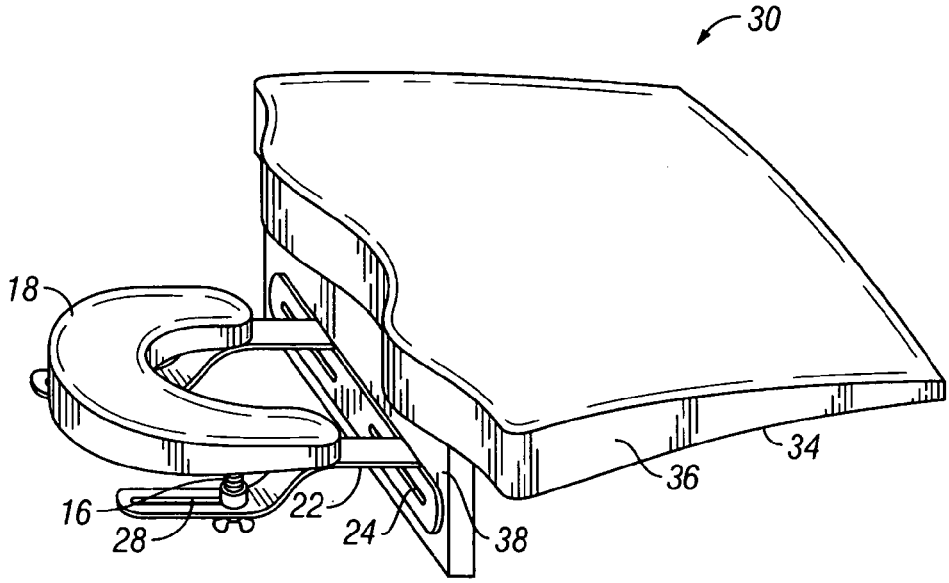
FIG. 3A shows a head support suspension system with a universal track support bracket attached to a torso platform according to an embodiment of the present invention.
Figure 3B:
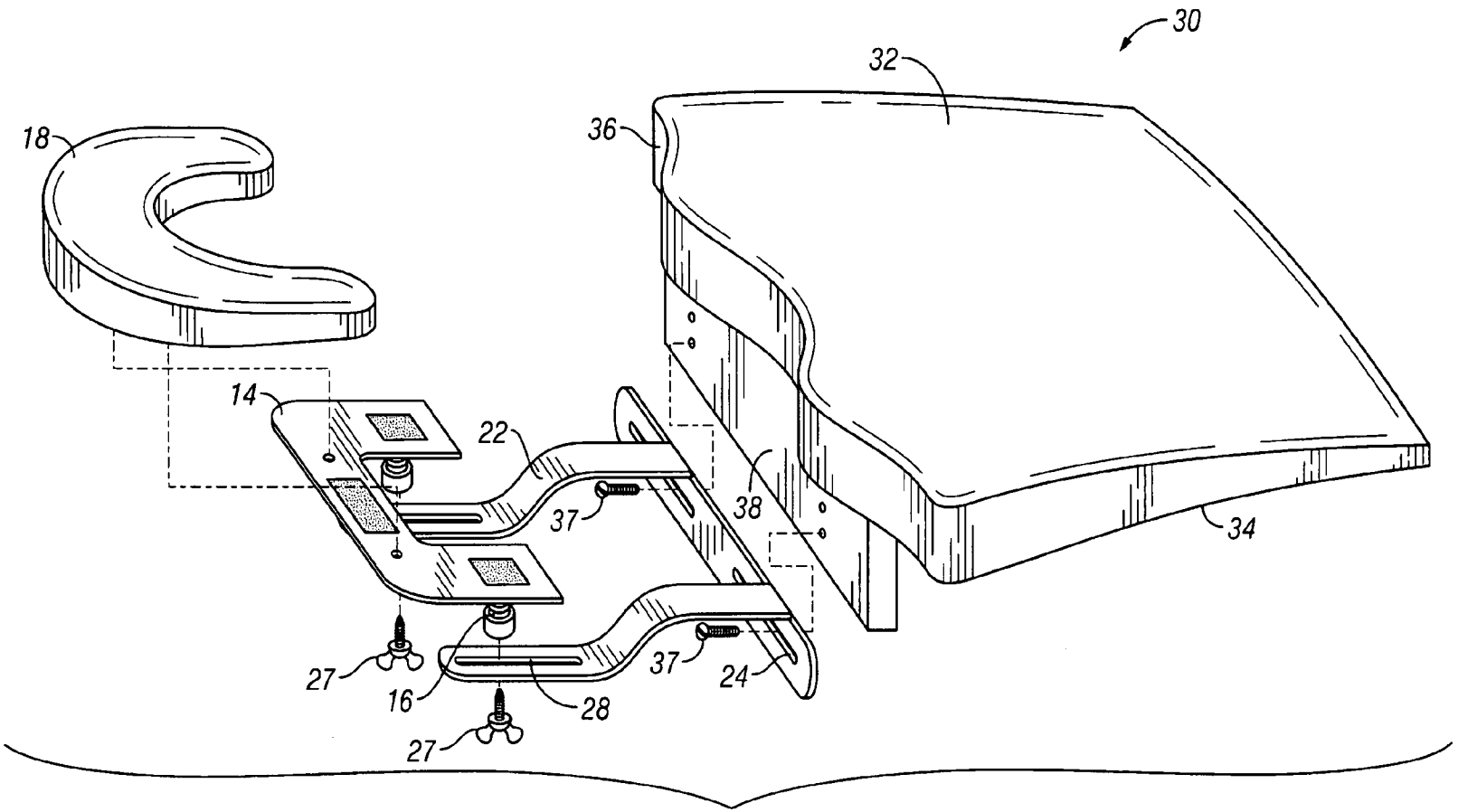
FIG. 3B shows an exploded view of a head support suspension system with a universal track support bracket attached to a torso platform according to an embodiment of the present invention.

Another embodiment of the present invention is a head support suspension system 30 attached to a torso massage platform 32, as shown in FIGS. 3A–3B. Suspension system 30 comprises a face plate 14 (see FIG. 3B), a suspension support unit 16, and a universal track support bracket 22. Torso platform 32 includes a torso base 34, a foam pad 36, and a support member 38. Torso base 34 may be made of any suitable substantially rigid material and may be of any desired shape. Foam pad 36 lies on top of torso base 34. Foam pad 36 may be contoured and may have a cut out for a neck and arm placement. Foam pad 36 may have a gradual slope to support a person's upper body with chest and stomach depressions for added comfort. Support member 38 is fixed to the underside of torso base 34 just below the neck cut-out. Support member 38 is rigidly fixed at a right angle to torso base 34. Universal track support bracket 22 is attached to support member 38 by an attachment means, such as a screw fastener 37. Support member 38 stabilizes torso platform 32 against a bed, table, bench or other flat surface to turn such surface into a massage table.

Figure 4:
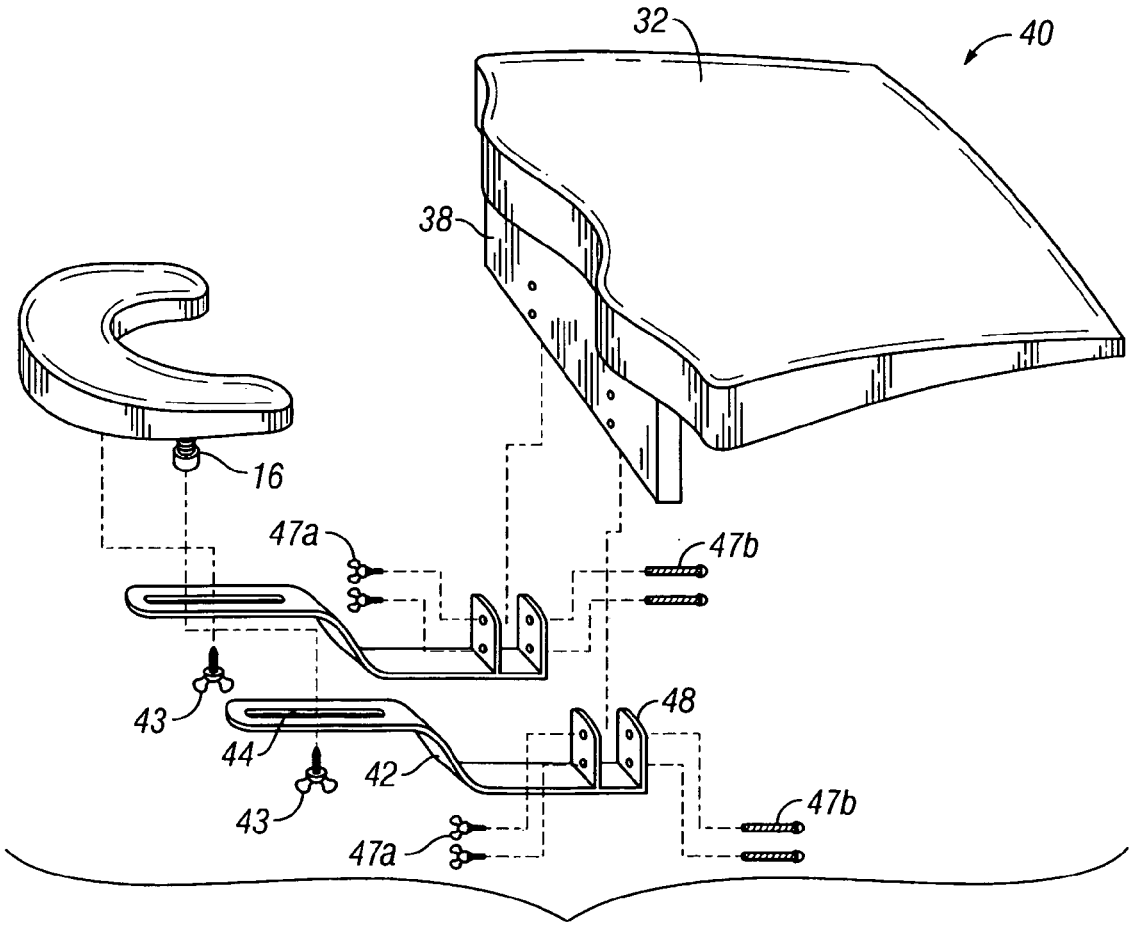
FIG. 4 shows an exploded view of a head support suspension system with standard support brackets attached to a torso platform according to an embodiment of the present invention.

FIG. 4 shows a head support suspension system 40 with standard support brackets 42 attached to a torso massage platform 32, according to an embodiment of the present invention. Two standard support brackets 42, are shown, each having a first end and a second end. Each first end of standard support brackets 42 has a vertical track 44 for adjustable attachment to suspension support unit 16. A lower end of suspension support unit 16 attaches to vertical track 44 of each bracket 42. The position of suspension support unit 16 may be adjusted on vertical track 44 by sliding suspension support unit 16 to the desired position along vertical track 44 for best custom fit. Suspension support unit 16 is secured to vertical track 44 by a fastening means, such as a screw fastener 43. Each second end of standard support brackets 42 has a two-prong standard bracket end 48 that attaches to support member 38 of torso platform 32 and secured by a fastening means, such as a screw fastener 47*a*, 47*b*.

Figures 5A, 5B:
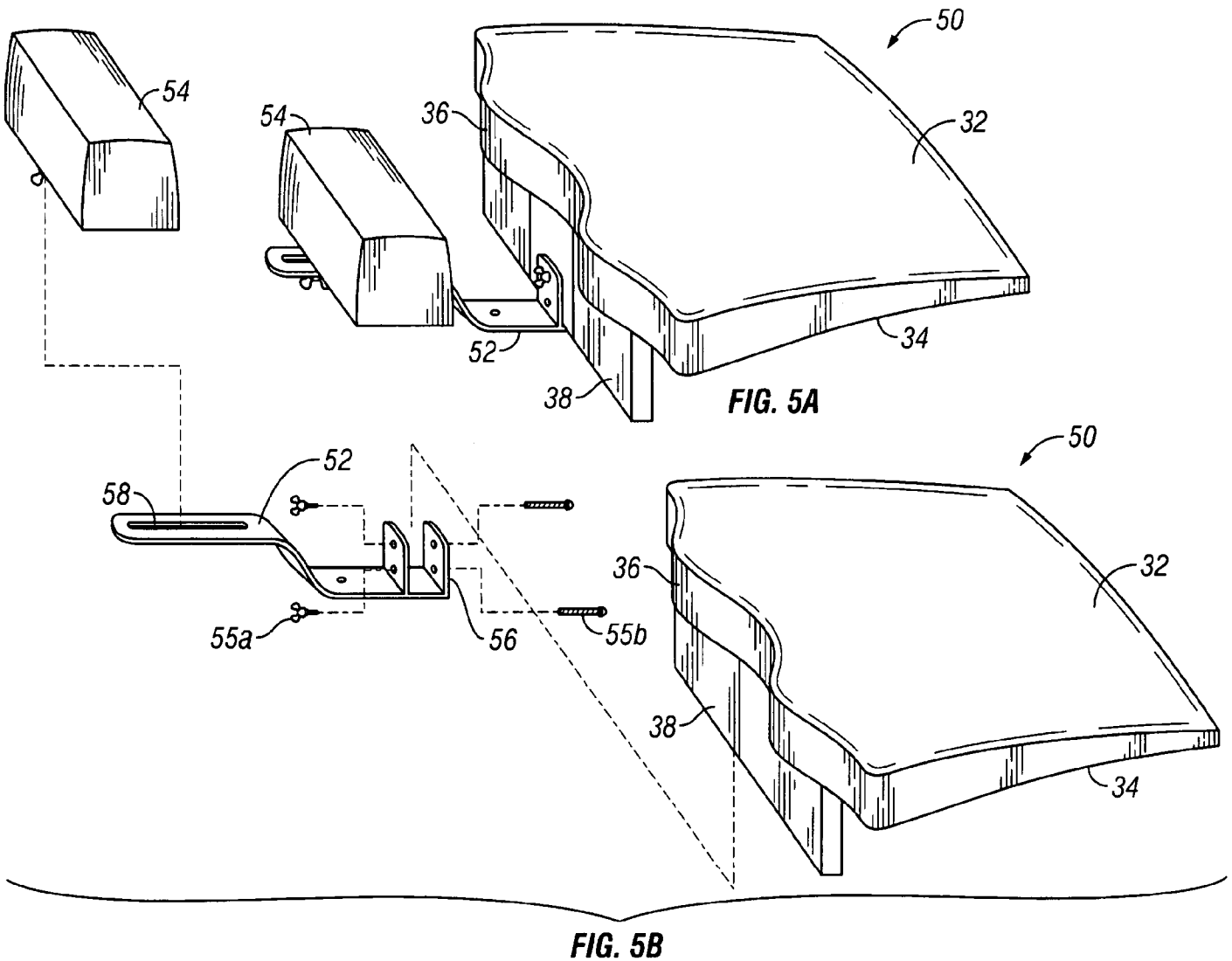
FIG. 5A shows a head support suspension system with a leaf spring bracket according to an embodiment of the present invention.
FIG. 5B shows an exploded view of a head support suspension system with a leaf spring bracket according to an embodiment of the present invention.

Still another embodiment of the present invention is a head support suspension system 50 with a leaf spring bracket 52, attached to a torso massage platform 32, as shown in FIG. 5A–5B. Suspension system 50 comprises a head pad 54 and a leaf spring support bracket 52. Torso platform 32 includes a torso base 34, a foam pad 36, and a support member 38. A first end of leaf spring bracket 52 has a vertical track 58 where head pad 54 is adjustably attached. The position of head pad 54 may be adjusted on vertical track 58 by sliding head pad 54 to the desired position along vertical track 58. A second end of leaf spring support bracket 52 has a two-prong standard bracket end 56 that is attached to support member 38 of torso platform via a fastening means, such as a screw fastener 55*a*, 55*b*.

Throughout the description and drawings, example embodiments are given with reference to specific configurations. It will be appreciated by those of ordinary skill in the art that the present invention can be embodied in other specific forms. Those of ordinary skill in the art would be able to practice such other embodiments without undue experimentation. The scope of the present invention, for the purpose of the present patent document, is not limited merely to the specific example embodiments of the foregoing description, but rather is indicated by the appended claims. All changes that come within the meaning and range of equivalents within the claims are intended to be considered as being embraced within the spirit and scope of the claims.

What is claimed is:

1. A head support suspension system for supporting the head, neck, and face of a subject during a body treatment on a massage table, the system comprising:

a. a face plate having a top side, an underside, and an attachment bracket fixed to the underside of the face plate;

b. a suspension support unit having an upper end and a lower end, the upper end being rigidly connected to the attachment bracket;

c. a universal track support bracket having a plurality of horizontal tracks and a plurality of vertical tracks; and d. a plurality of adjustable connecting rods, each rod having a first end and a second end, each first end is adjustably attached to one of the plurality of horizontal tracks and each second end is inserted into the massage table;

wherein the lower end of the suspension support unit is adjustably attached to each of the plurality of vertical tracks such that support and compensation is provided when pressure is applied to the subject.

2. The suspension system of claim 1, wherein the face plate is substantially U-shaped and further comprises a cushion attached to the top side of the face plate.

3. The suspension system of claim 1, wherein the suspension support unit comprises a plurality of spring coils attached to the attachment bracket.

* * * * *